US011988080B2

(12) United States Patent
Cook et al.

(10) Patent No.: US 11,988,080 B2
(45) Date of Patent: May 21, 2024

(54) PERFORATING SYSTEM ORIENTATION APPARATUS AND METHOD OF ORIENTING PERFORATING GUNS

(71) Applicant: Halliburton Energy Services, Inc., Houston, TX (US)

(72) Inventors: Jason Karl Cook, Crowley, TX (US); Jeffery Richard Acker, Duncanville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/959,775

(22) Filed: Oct. 4, 2022

(65) Prior Publication Data

US 2024/0110468 A1 Apr. 4, 2024

(51) Int. Cl.
*E21B 43/119* (2006.01)
*E21B 43/117* (2006.01)

(52) U.S. Cl.
CPC ..... *E21B 43/119* (2013.01); *E21B 43/117* (2013.01)

(58) Field of Classification Search
CPC .... E21B 43/119; E21B 43/117; E21B 43/116; E21B 23/02; E21B 33/1292; E21B 33/1293
See application file for complete search history.

(56) References Cited

U.S. PATENT DOCUMENTS

| | | | | |
|---|---|---|---|---|
| 7,385,523 | B2 * | 6/2008 | Thomeer | E21B 47/26 340/854.8 |
| 9,145,763 | B1 | 9/2015 | Sites, Jr. | |
| 10,677,025 | B2 | 6/2020 | Al-Gouhi | |
| 2004/0026090 | A1 * | 2/2004 | McGlothen | E21B 7/06 166/380 |
| 2008/0264639 | A1 | 10/2008 | Parrott et al. | |
| 2014/0144652 | A1 * | 5/2014 | Steele | E21B 41/0035 166/117.6 |

(Continued)

FOREIGN PATENT DOCUMENTS

| | | |
|---|---|---|
| EP | 1473437 | 11/2004 |
| EP | 3354844 | 8/2018 |

OTHER PUBLICATIONS

International Search Report and Written Opinion for International Patent Application No. PCT/US2022/047460 dated Jun. 20, 2023.

*Primary Examiner* — Daniel P Stephenson
(74) *Attorney, Agent, or Firm* — John W. Wustenberg; C. Tumey Law Group, PLLC

(57) ABSTRACT

A system for landing a perforating gun in a particular orientation may include a landing housing securable within a wellbore and having at least one key slot extending into an inner surface of the landing housing. The system further includes a latch assembly configured to couple to the landing housing in a particular orientation. The latch assembly includes a tubular support structure and at least one key feature configured to extend and retract radially through a sidewall of the tubular support structure. The latch assembly further includes a biasing mechanism configured to bias the at least one key feature into the at least one key slot to couple the latch assembly to the landing housing. Additionally, the system includes a perforating gun system secured to the latch assembly such that the orientation of the latch assembly aims the perforating gun system in the wellbore.

18 Claims, 8 Drawing Sheets

(56) References Cited

U.S. PATENT DOCUMENTS

| | | | | |
|---|---|---|---|---|
| 2016/0215596 | A1 | 7/2016 | Cook et al. | |
| 2016/0237793 | A1 | 8/2016 | Albers et al. | |
| 2017/0211363 | A1* | 7/2017 | Bradley | F42B 5/035 |
| 2018/0258701 | A1* | 9/2018 | Saurer | E21B 47/024 |
| 2019/0390526 | A1* | 12/2019 | Durst | E21B 23/01 |
| 2022/0127935 | A1 | 4/2022 | Grove et al. | |

* cited by examiner

PERFORATING SYSTEM ORIENTATION APPARATUS AND METHOD OF ORIENTING PERFORATING GUNS

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. Traditionally the casing string is cemented to the wellbore. To access the hydrocarbons for production, a perforating gun system may be deployed into the casing string via a tool string. The tool string (e.g., a tubing string, wireline, slick line, coil tubing) lowers the perforating gun system into the casing string to a desired position within the wellbore. The perforating gun may be landed once the perforating gun system is lowered to a target position in the wellbore, which is generally a position adjacent to a subterranean formation having hydrocarbons. Traditionally, landing the perforating gun system may include setting the perforating gun system on a packer, gun hanger, tubing anchor, etc. Alternatively, the perforating gun system may continue to be supported by the tool string at the target position. Once the perforating gun system is landed, the shaped charges may be detonated to perforate the casing string, the cementing, and the subterranean formation such that hydrocarbons may flow into the casing string via the perforation. Unfortunately, current landing techniques may fail to land the perforating gun system consistently and accurately at a desired angular orientation in the wellbore, which may hinder potential production in the wellbore.

BRIEF DESCRIPTION OF THE DRAWINGS

These drawings illustrate certain aspects of some of the embodiments of the present disclosure and should not be used to limit or define the method.

DETAILED DESCRIPTION

Provided are systems for landing a perforating gun in a specific orientation and, more particularly, example embodiments may include a perforating gun system secured to a latch assembly that is lowered down into a landing housing and only coupled to the landing housing when slid into the landing housing in a particular orientation, such that the latch assembly and perforating gun system may be reinserted into the landing housing until inserted in the correct orientation. As set forth in detail below, the latch assembly and landing housing may include various features to ensure that the latch assembly may only be coupled to the landing housing in a specific orientation. Further, the latch assembly and/or landing housing may include additional features to guide the latch assembly to the specific orientation with respect to the landing housing. These features may improve the effectiveness and reliability of the perforating gun system by consistently ensuring that shaped charges of the perforating gun system are detonated in a desired orientation in the wellbore.

Figure 1:
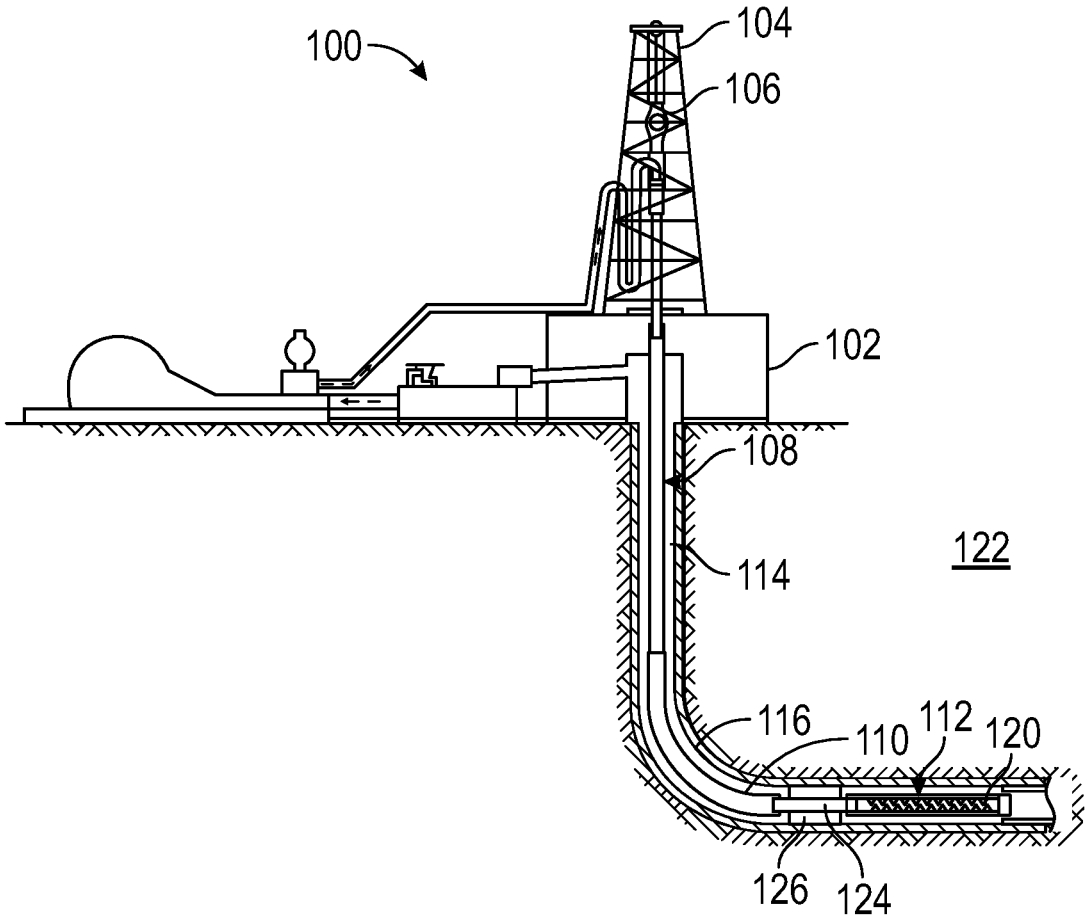
FIG. 1 illustrates a side elevation, partial cross-sectional view of an operational environment for a drilling system, in accordance with some embodiments of the present disclosure.

FIG. 1 illustrates a side elevation, partial cross-sectional view of an operational environment for a drilling system, in accordance with some embodiments of the present disclosure. It should be noted that while FIG. 1 generally depicts a land-based drilling and completion assembly, those skilled in the art will readily recognize that the principles described herein are equally applicable to subsea drilling and completion operations that employ floating or sea-based platforms and rigs, without departing from the scope of the disclosure. As illustrated, the drilling and completion assembly 100 includes a platform 102 that supports a derrick 104 having a traveling block 106 for raising and lowering a tool string 108. The tool string 108 includes, but is not limited to, a work string 110, a perforating gun system 112, and any other suitable tools, as generally known to those skilled in the art. While not shown, tubing string, wireline, slick line, and/or coil tubing may be used instead of conventional work string 110 for supporting the perforating gun system 112.

The work string 110 is configured to lower the perforating gun system 112 into a wellbore 114. Specifically, the perforating gun system 112 may be secured to a latch assembly 124. The work string 110 may be coupled to the latch assembly 124, and the perforating gun system 112 may be lowered into the wellbore 114 via lowering the latch assembly 124 into the wellbore 114. As illustrated, the wellbore 114 may be lined with casing. The casing 116 is configured to protect the wellbore 114 from failure (e.g., collapse, erosion) and to provide a fluid path for hydrocarbons during production. To access the hydrocarbons, the work string 110 lowers the latch assembly 124 and perforating gun system 112 to a position such that shaped charges 120 are disposed adjacent to a subterranean formation 122 having the hydrocarbons and the perforating gun system 112 detonates the shaped charges 120. The detonations may perforate the casing 116, the cementing, and the subterranean formation 122 in the respective paths of the shaped charge detonations such that hydrocarbons may flow into the casing 116 string via the perforations.

A landing housing 126 may be secured downhole in the wellbore proximate the subterranean formation 122 having the hydrocarbons. The latch assembly 124 is configured to couple to the landing housing 126 in a particular orientation.

As the perforating gun system 112 is secured to the latch assembly 124, landing the latch assembly 124 in a particular orientation may aim the perforating gun system 112 in a particular direction within the wellbore 114 such that the perforating gun system 112 may detonate the shaped charges 120 in a desired angular direction for maximizing flow of hydrocarbons into the wellbore 114.

In some embodiments, logging tools may be used to determine the depth, position, and orientation of the landing housing 126 in the wellbore 114. Alternatively, the landing housing 126 may be secured to a packer assembly or other downhole assembly such that the orientation of the landing housing 126 may be known. Based on the known orientation of the landing housing 126 in the wellbore 114 and the orientation of the latch assembly 124 with respect to the landing housing 126 when coupled, the perforating gun system 112 may be mounted to the latch assembly such that the perforating gun system 112 is positioned in a desired orientation in the wellbore 114 when the latch assembly is coupled to the landing housing 126. In some embodiments, the perforating gun system 112 may be secured to the latch assembly 124 via an indexing thread. The indexing thread may be configured to secure the perforating gun system 112 to the latch assembly 124 at an adjustable angular orientation such that the perforating gun system 112 may be secured to the latch assembly 124 at any desired angular orientation.

Once the perforating gun system 112 is secured to the latch assembly 124 in the desired orientation, the latch assembly 124 and perforating gun system 112 may be lowered into the wellbore 114 to depth of the landing housing 126. Once positioned above the landing housing 126, the work string 110 may drive the latch assembly 124 into the landing housing 126. If inserted into the landing housing 126 in the correct orientation, the latch assembly 124 is configured to couple to the landing housing 126 as set forth in detail below. However, if the latch assembly 124 is incorrectly oriented with respect to the landing housing 126, the latch assembly 124 may slide through the landing housing 126. A sensor assembly (e.g., a weight indicator) may determine if the latch assembly 124 successfully coupled to the landing housing 126 or continued to move downhole past the landing housing 126. If the sensor assembly determine that the latch assembly 124 failed to couple to the landing housing 126, the work string 110 may be retracted to raise the latch assembly 124 to a position uphole from the landing housing 126. The latch assembly 124 may be indexed (e.g., rotated within the wellbore) and again lowered into the landing housing 126. The system may be configured to repeat this process until the latch assembly 124 successfully couples to the landing housing 126 in the desired orientation.

Figure 2:
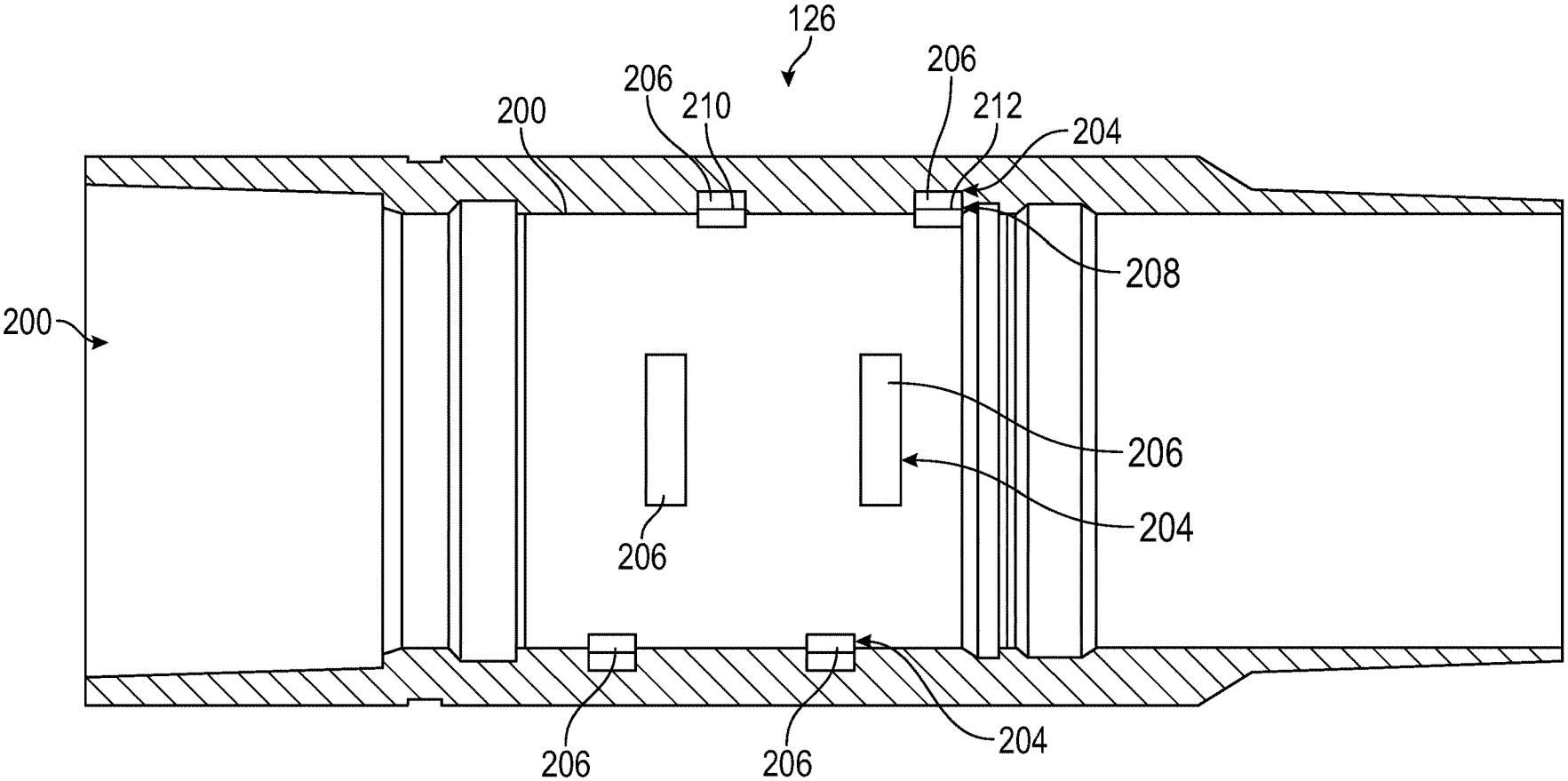
FIG. 2 illustrates a cross-sectional view of a landing housing for landing and orienting a perforating gun system, in accordance with some embodiments of the present disclosure.

FIG. 2 illustrates a cross-sectional view of a landing housing for landing and orienting a perforating gun system, in accordance with some embodiments of the present disclosure. The landing housing 126 may have a tubular shape with an inner surface 200 defining a central bore 202 of the landing housing 126. Further, as set forth above, the landing housing 126 is securable within the wellbore 114 of a downhole drilling operation and is configured to couple to the latch assembly 124 in a particular orientation (shown in FIG. 1). Specifically, the landing housing 126 comprises at least one key slot 204 extending into the inner surface 200 of the landing housing 126. The at least one key slot 204 is configured to receive at least one key (e.g., at least one key feature 304) of the latch assembly 124 in the particular orientation (shown in FIGS. 3-4). As set forth in detail below, receiving the at least one key feature 304 in the at least one key slot 204 may couple the latch assembly 124 to the landing housing 126.

Moreover, as illustrated, the landing housing 126 may comprise a plurality of key slots 204 extending into the inner surface 200 of the landing housing 126. Each key slot of the plurality of key slots 204 may comprise comprises a plurality of axially aligned recesses 206 in the inner surface 200 of the landing housing 126. For example, the plurality of key slots 204 may comprise a first key slot 208 having a first recess 210 and a second recess 212 that are axially aligned along the inner surface 200 of the landing housing 126. A corresponding first key feature 338 (shown in FIG. 3) may be configured to extend into the first key slot 208 to couple the latch assembly 124 to the landing housing 126.

Figure 3:
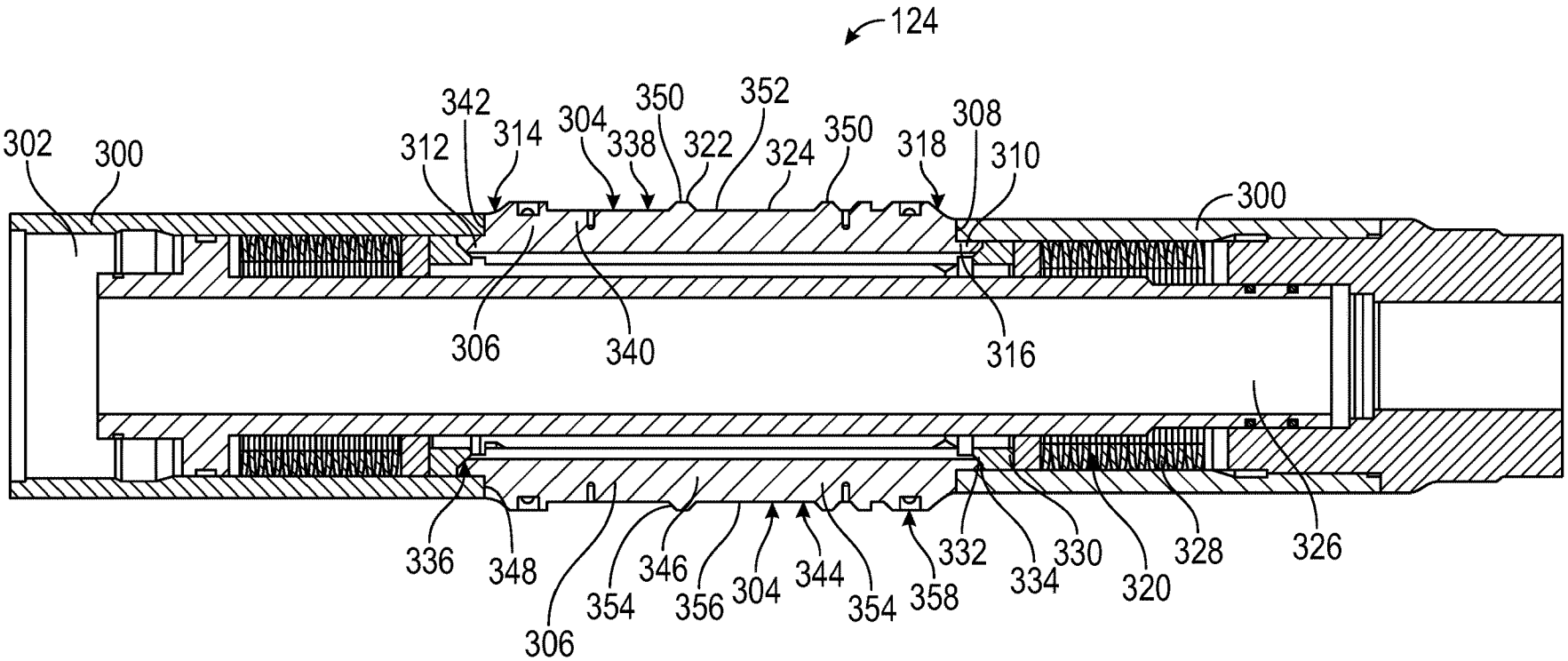
FIG. 3 illustrates a cross-sectional view of a latch assembly couplable to the landing housing, in accordance with some embodiments of the present disclosure.

FIG. 3 illustrates a cross-sectional view of a latch assembly couplable to the landing housing, in accordance with some embodiments of the present disclosure. As set forth above, the latch assembly 124 is configured to couple to the landing housing 126 (shown in FIG. 2) in a particular orientation. The latch assembly 124 includes a tubular support structure 300 having a central latch assembly bore 302. Further, the latch assembly 124 includes at least one key feature 304 having a body portion 306 configured to extend and retract radially through a sidewall 308 of the tubular support structure 300. The body portion 306 may have at least one radial shoulder 310 for restraining radially outward movement of the at least one key feature 304 at a maximum extension of the at least one key feature 304. In the illustrated embodiment, the at least one radial shoulder 310 comprises a first radial shoulder 310 disposed at an uphole end 314 of the at least one key feature 304 and a second radial shoulder 316 disposed at a downhole end 318 of the at least one key feature 304. The first radial shoulder 312 and the second radial shoulder 316 may interface with respective portions of the tubular support structure 300 to prevent the at least one key feature 304 from ejecting from the latch assembly 124 in the wellbore 114 (shown in FIG. 1).

The latch assembly 124 may further include a biasing mechanism 320 configured to bias the at least one key feature 304 in a radially outward direction with respect to the tubular support structure 300. Biasing the at least one key feature 304 in the radially outward direction is configured to drive the at least one key feature 304 into the at least one key slot 204 (shown in FIG. 2). Specifically, at least one key protrusion 322 of the at least one key feature 304 may be driven into the at least one key slot 204 to couple the latch assembly 124 to the landing housing 126. The at least one key protrusion 322 is formed on a radially outer surface 324 of the body portion 306 such that the at least one key protrusion 322 may be inserted into the at least one key slot 204 formed on the inner surface 200 of the landing housing 126 in response to radially outward movement of the at least one key feature 304.

Further, the biasing mechanism 320 may be disposed within the central latch assembly bore 302 of the tubular support structure 300. In the illustrated embodiment, the biasing mechanism 320 also comprises a central through bore 326 such that downhole tools may be run through the latch assembly 124. Moreover, the biasing mechanism 320 may comprise belleville springs 328 and push cams 330 to bias the at least one key feature 304. However, the biasing mechanism 320 may include any suitable biasing mechanism 320 (e.g., hydraulic assembly, compression springs, etc.). In the illustrated embodiment, the belleville springs 328 are configured to drive a respective push cam 330 axially into a slanted surface 332 of the body portion 306 of the at least one key feature 304. The push cams 330 may also include respective slanted faces 334 configured to contact corresponding slanted surfaces 332 of the body portion 306 of the at least one key feature 304 such that the push cams 330 may contact the body portion 306 at slanted interfaces 336. The sidewalls 308 of the tubular support structure 300 may restrain axial movement of the body portion 306 of the at least one key feature 304. As such, axially movement of the push cams 330 may drive radially movement of the at least one key feature 304, via the slanted interfaces 336, such that the belleville springs 328 and the push cams 330 may bias the at least one key feature 304 in the radially outward direction with respect to the tubular support structure 300.

Moreover, in the illustrated embodiment, the latch assembly 124 comprises a plurality of key features 304. For example, as illustrated, the latch assembly 124 may include a first key feature 338 having a first body portion 340 configured to extend and retract radially through a first sidewall 342 of the tubular support structure 300 and a second key feature 344 having a second body portion 346 configured to extend and retract radially through a second sidewall 348 of the tubular support structure 300. Further, the first key feature 338 comprises a plurality of first key protrusions 350 formed on a first radially outer surface 352 of the first body portion 340, and the second key feature 344 comprises a plurality of second key protrusions 354 formed on a second radially outer surface 356 of the second body portion 346.

The first key protrusions 350 may be different from the second key protrusions 354. That is, the first key protrusions 350 may be shaped, positioned, and/or oriented in a different manner than the second key protrusions 354. In the illustrated embodiment, the first key protrusions 350 are positioned closer to a downhole end 318 of the first key feature 338 than the second key protrusions 354 with respect to a downhole end 358 of the second key feature 344. The latch assembly 124 may also comprise a plurality of biasing mechanisms 320 configured to bias the first key feature 338 and the second key feature 344 in the radially outward direction with respect to the tubular support structure 300 to drive the respective first key protrusions 350 and second key protrusions 354 into corresponding keys slots of the landing housing. The first key protrusions 350 may be different than the second key protrusions 354 such that the first key protrusions 350 may not be inserted into a key slot corresponding to the second key protrusions 354 and vice versa, which may prevent the latch assembly 124 from coupling to the landing housing in an incorrect orientation. As set forth above, the latch assembly 124 is configured to couple to the landing housing 126 in a correct orientation such that the perforating gun system 112 may be aim in a desired direction in the wellbore 114.

Figure 4A:
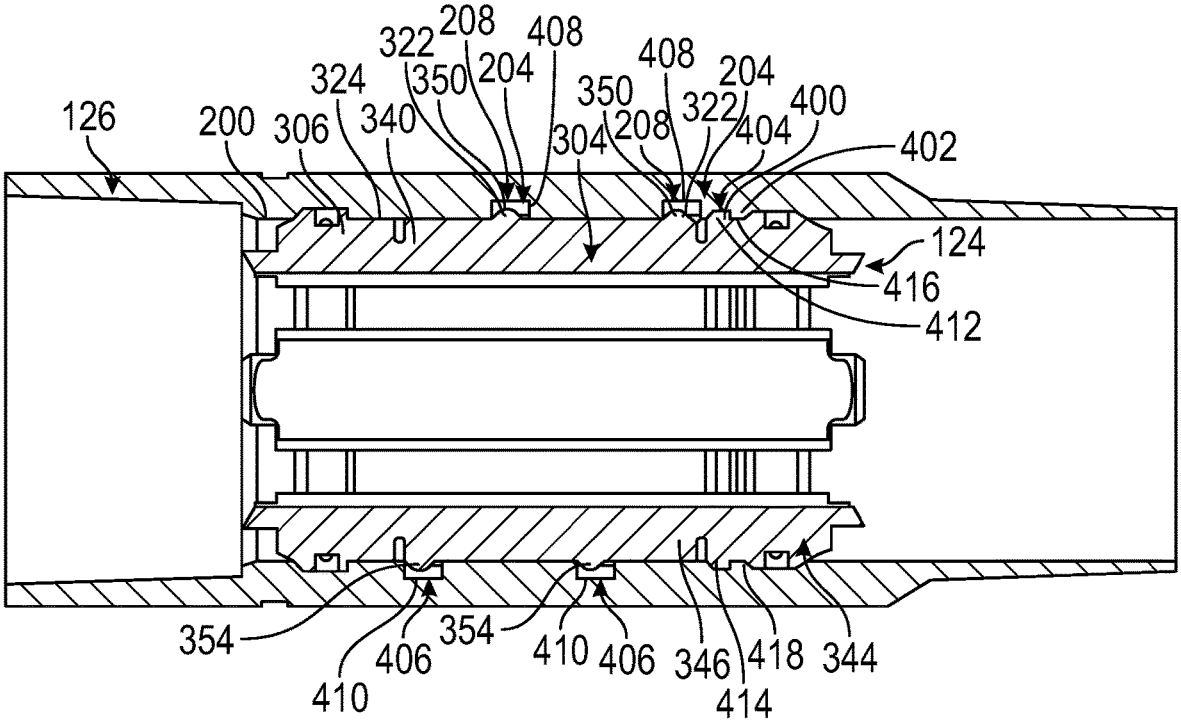
FIGS. 4A-B illustrate cross-sectional views of the latch assembly disposed within the landing housing, in accordance with some embodiments of the present disclosure.
Figure 4B:
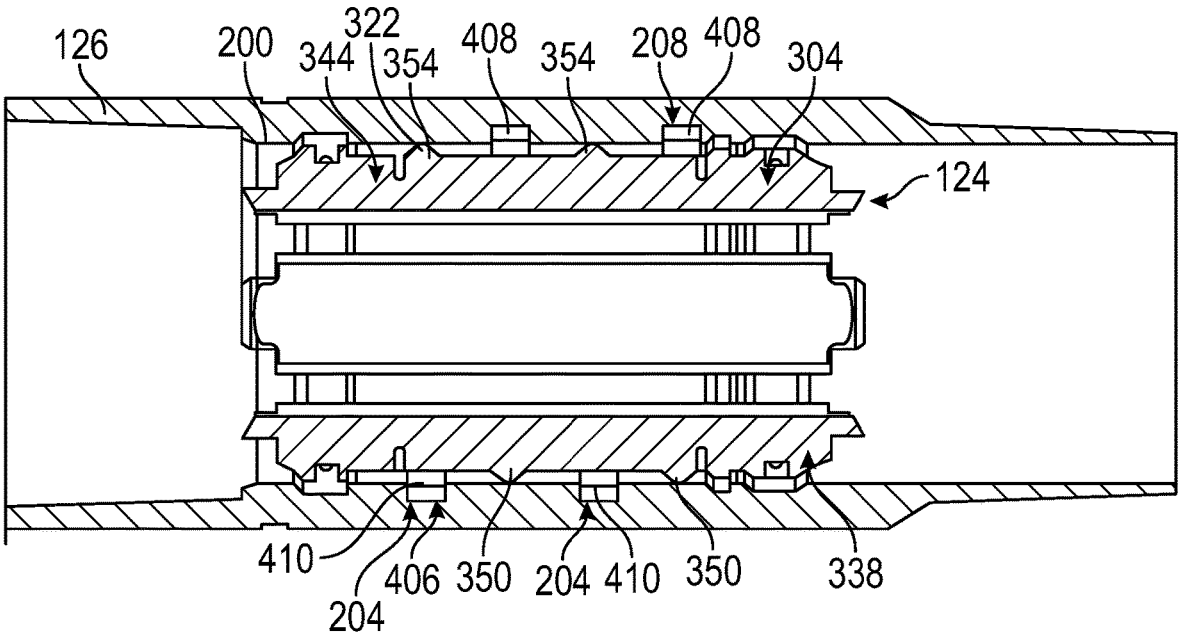

FIGS. 4A-B illustrate cross-sectional views of the latch assembly disposed within the landing housing, in accordance with some embodiments of the present disclosure. In particular, FIG. 4A illustrates the latch assembly 124 coupled to the landing housing 126. As set forth above, the plurality of biasing mechanisms 320 (shown in FIG. 3) of the latch assembly 124 are configured to bias the plurality of key features 304 in the radially outward direction. As the latch assembly 124 slides into the landing housing 126, the inner surface 200 of the landing housing 126 may contact the respective key protrusions 322 of plurality of key features 304, which may drive the plurality of key features 304 radially inward such that the latch assembly 124 may continue to slide through the landing housing 126. However, in response to the respective key protrusions 322 axially and circumferentially aligning with their respective key slots 204, the biasing mechanisms 320 may drive the key features 304 to extend radially outward, such that the respective key protrusions 322 are inserted in their corresponding key slots 204. Inserting the respective key protrusions 322 in their corresponding key slots 204 may couple the latch assembly 124 to the landing housing 126.

Each key feature of the plurality of key features 304 may further include at least one load bearing protrusion 400 for coupling the latch assembly 124 to the landing housing 126. Specifically, the at least one load bearing protrusion 400 may be configured to support the weight of the latch assembly 124, as well as any other tools (e.g., the perforating gun system 112) secured to the latch assembly 124. The at least one load bearing protrusion 400 may be formed on the radially outer surface 324 of the body portion 306 of the corresponding key feature 304. In the illustrated embodiment, the at least one load bearing protrusion 400 is disposed proximate a downhole end of the key features 304. However, the at least one load bearing protrusion 400 may be disposed in any suitable position and/or orientation on the radially outer surface 324 of the body portion 306. Further, the at least one load bearing protrusion 400 is configured to interface with a corresponding load bearing shoulder 402 formed in the inner surface 200 of the landing housing 126. The at least one load bearing protrusion 400 may be configured to interface with the corresponding load bearing shoulder 402 with the key feature 304 disposed in the corresponding key slot 204. As illustrated, a load bearing recess 404 may also be formed in the inner surface 200 of the landing housing 126 such that the at least one load bearing shoulder 402 has sufficient clearance to interface with the corresponding load bearing shoulder 402 when the key feature 304 is in the extended position.

In the illustrated embodiment, the plurality of key slots 204 includes at least the first key slot 208 and a second key slot 406. However, the landing housing 126 may include any suitable number of key slots 204. The first key slot 208 is configured to receive the corresponding first key protrusions 350. Specifically, the first key slot 208 comprises a plurality of axially aligned first recesses 408 in the inner surface 200 of the landing housing 126. These axially aligned first recesses 408 have a same shape as the first key protrusions 350 such that the first key protrusions 350 may fit in the first recesses 408. The first axially aligned recesses 206 may be substantially the same size as the first key protrusions 350 such that other key protrusions (e.g., the second key protrusions 354) may not fit within the axially aligned first recesses 408 in an embodiment where the second key protrusions 354 of the second key feature 344 have a different shape than the first key protrusions 350. Further, the axially aligned first recesses 408 may be positioned and spaced to match the positioning and spacing of the first key protrusions 350. Moreover, the second key slot 406 is configured to receive the corresponding second key protrusions 354. Similarly, axially aligned second recesses 410 of the second key slot 406 may have a same shape, positioning, and spacing as the corresponding second key protrusions 354 such that the second key protrusions 354 may fit in the second recesses 410.

As illustrated, the plurality of key features 304 includes at least a first key feature 338 and a second key feature 344. However, the latch assembly 124 may include any suitable number of key features 304. The first key feature 338 and the second key feature 344 may be biased in a radially outward direction with respect to the tubular support structure 300 to drive the respective first key protrusions 350 and second key protrusions 354 into corresponding first recesses 408 of the first key slot 208 and second recesses 410 of the second key slot 406 to couple the latch assembly 124 to the landing housing 126. However, the respective key protrusions 350, 354 may only extend into the corresponding key slots 208, 406 when the respective key protrusions 350, 354are axially and circumferentially aligned with their corresponding keys slots 208, 406. For example, in the illustrated embodiment, both protrusions of the first key protrusions 350 must be aligned with both of the corresponding first recesses 408 for the first key feature 338 to extend into the corresponding first key slot 208.

Moreover, the first key feature 338 and the second key feature 344 each comprise at least one load bearing protrusion 400 formed on the radially outer surface 324 of the respective first and second body portions 340, 346. As illustrated, the first key feature 338 may include a first load bearing protrusion 412 and the second key feature 344 may include a second load bearing protrusion 414. However, the key features 304 may include any number of load bearing protrusions 400. The first and second load bearing protrusions 412, 414 are configured to interface with corresponding load bearing shoulders 402 (e.g., a first load bearing shoulder 416 and a second load bearing shoulder 418) formed in the inner surface 200 of the landing housing 126.

FIG. 4B illustrates the latching assembly failing to couple to the landing housing as the latching assembly is positioned at an incorrect orientation with respect to the landing housing. As set forth above, the inner surface 200 of the landing housing 126 may contact the respective key protrusions 322 of plurality of key features 304, which may drive the plurality of key features 304 radially inward. Specifically, contact between the respective key protrusions 322 and the inner surface 200 of the landing housing 126 may drive the respective key features 304 (e.g., the first key feature 338 and the second key feature 344) to a retracted position such that the latch assembly 124 slides through the landing housing 126.

The respective key features 304 may remain in the retracted position should the latch assembly 124 slide through the landing housing 126 in an incorrect orientation. The first key protrusions 350 form a first key profile on the first key feature 338 and the second key protrusions 354 form a second key profile on the second key feature 344. The key profiles may comprise positioning, spacing, shape, sizing, or some combination thereof of the respective key protrusions 350, 354. As illustrated, the first key profile may be different than the second key profile. In some embodiments, all key features 304 of the latch assembly 124 must extend into their respective key slots 204 for the latch assembly 124 to couple to the landing housing 126. Accordingly, as the first key feature 338 and the second key feature 344 have different key profiles, the first key feature 338 and the second key feature 344 may only both extend into their respective key slots 208, 406 in a single angular orientation.

In the illustrated embodiment, the first key feature 338 is circumferentially aligned with the second key slot 406 and the second key feature 344 is circumferentially aligned with the first key slot 208. As illustrated, at least one first key protrusion 350 contacts the inner surface 200 of the landing housing 126 when circumferentially aligned with the second recesses 410 of the second key slot 406, which restrains the first key feature 338 from extending into the second key slot 406. Further, at least one second key protrusion 354 contacts the inner surface 200 of the landing housing 126 when circumferentially aligned with the first recesses 408 of the first key slot 208, which restrains the second key feature 344 from extending into the first key slot 208. As such, the latch assembly 124 may fail to couple with the landing housing 126 and continue to slide through the landing housing 126.

FIGS. 5A-D illustrate cross-sectional views of key features of the latch assembly, in accordance with some embodiments of the present disclosure. As set forth above, each key feature may include unique key protrusions that form different key profiles.

Figure 5B:
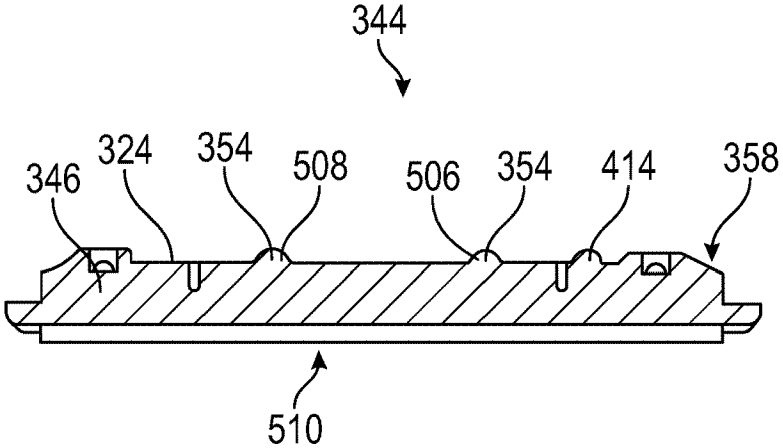
FIGS. 5A-D illustrate cross-sectional views of key features of the latch assembly, in accordance with some embodiments of the present disclosure.
Figure 5D:
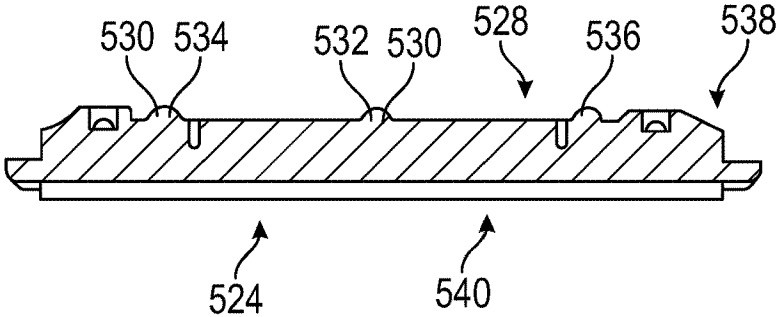
Figure 5A:
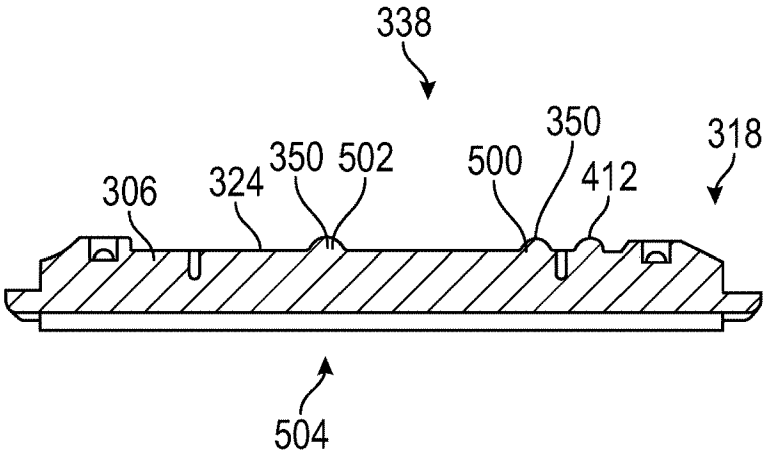

In particular, FIG. 5A illustrates a first key feature 338 of the latch assembly 124 (shown in FIG. 3). The first key feature 338 comprises first key protrusions 350 formed on a radially outer surface 324 of the body portion 306. As illustrated, the first key protrusions 350 include a first lower key protrusion 500 and a first upper key protrusion 502. However, in some embodiments, the first key protrusions 350 may include additional key protrusions. The first key feature 338 further includes the first load bearing protrusion 412 positioned proximate the downhole end 318 of the first key feature 338. In some embodiments, the first key feature 338 may include additional load bearing protrusions for supporting the latch assembly 124. Moreover, the first lower key protrusion 500 may be disposed proximate the first load bearing protrusion 412. The first upper key protrusion 502 may be disposed proximate an upper middle portion 504 of the first key feature 338.

FIG. 5B illustrates a second key feature 344 of the latch assembly 124. The second key feature 344 comprises second key protrusions 354 formed on a radially outer surface 324 of the second body portion 346. As illustrated, the second key protrusions 354 include a second lower key protrusion 506 and a second upper key protrusion 508. The second key feature 344 further includes a second load bearing protrusion 414 positioned proximate the downhole end 358 of the second key feature 344. The second lower key protrusion 506 may be disposed proximate the second load bearing protrusion 414 but further uphole from the second load bearing protrusion 414 in comparison to the first lower key protrusion 500 and the first load bearing protrusion 412. The second upper key protrusion 508 may be disposed proximate an upper middle portion 510 of the second key feature 344, but further uphole in comparison to the first upper key protrusion 502. Accordingly, the second key profile may be different than the first key profile such that the latch assembly 124 may only couple to the landing housing 126 in a single orientation.

Figure 5C:
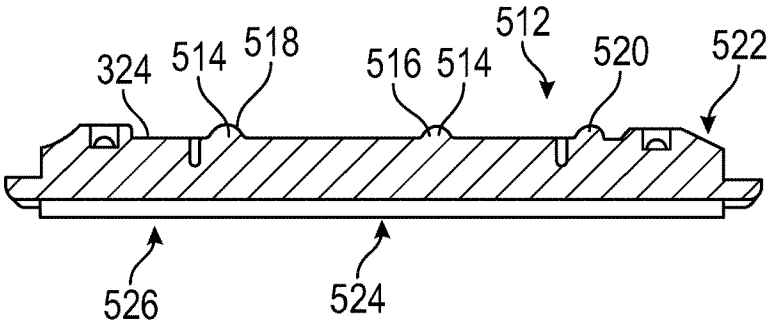

FIG. 5C illustrates a third key feature 512 of the latch assembly 124. The third key feature 512 comprises third key protrusions 514 formed on a radially outer surface 324 of the body portion 306. In some embodiments, the third key feature 512 may have a same key profile as the first key feature 338 or the second key feature 344, as only one key feature of the plurality of key features must have a unique key profile to restrain coupling between the latch assembly 124 and the landing housing 126 in all but one orientation. However, as illustrated, the third key profile is different from both the first and second key profiles. As illustrated, the third key protrusions 514 of the third key feature 512 include a third lower key protrusion 516 and a third upper key protrusion 518. The third key feature 512 further includes a third load bearing protrusion 520 positioned proximate a downhole end 522 of the third key feature 512. The third lower key protrusion 516 may be disposed proximate a middle portion 524 of the third key feature 512, and the third upper key protrusion 518 may be disposed proximate an upper portion 526 of the third key feature 512. Accordingly, the third key profile may be different than the first and second key profiles.

FIG. 5D illustrates a fourth key feature 528 of the latch assembly 124. In some embodiments, the fourth key feature 528 may have a same key profile as the first key feature 338, the second key feature 344, or the third key feature 512. Only one key feature of the plurality of key features must have a unique key profile to restrain coupling between the latch assembly and the landing housing in all but one orientation. As set forth in detail above, having the latch assembly 124 couple to the landing housing 126 in only a single orientation may allow the perforating gun system 112 to be secured to the latch assembly 124 in a particular orientation such that the perforating gun system 112 may be placed at a desired angular orientation in the wellbore 114 when the latch assembly 124 is coupled to the landing housing 126.

As illustrated, the fourth key profile is different from the first, second, and third key profiles. As illustrated, fourth key protrusions 530 of the fourth key feature 528 include a fourth lower key protrusion 532 and a fourth upper key protrusion 534. The fourth key feature 528 further includes a fourth load bearing protrusion 536 positioned proximate a downhole end 538 of the fourth key feature 528. The fourth lower key protrusion 532 may be disposed proximate a middle portion 540 of the fourth key feature 528, but further uphole in comparison to the third lower key protrusion 516 of the third key feature 512. Moreover, the fourth upper key protrusion 534 may be disposed proximate an upper portion 542 of the fourth key feature 528, but further uphole in comparison to the third upper key protrusion 518. Accordingly, the fourth key profile may be different than the first, second, and third key profiles. In some embodiments, the latch assembly 124 may include additional key features having unique key profiles. The unique key profile may have respective key protrusions having different positions, spacing, sizing, orientation, or some combination thereof, then the key profiles set forth above.

Figure 6:
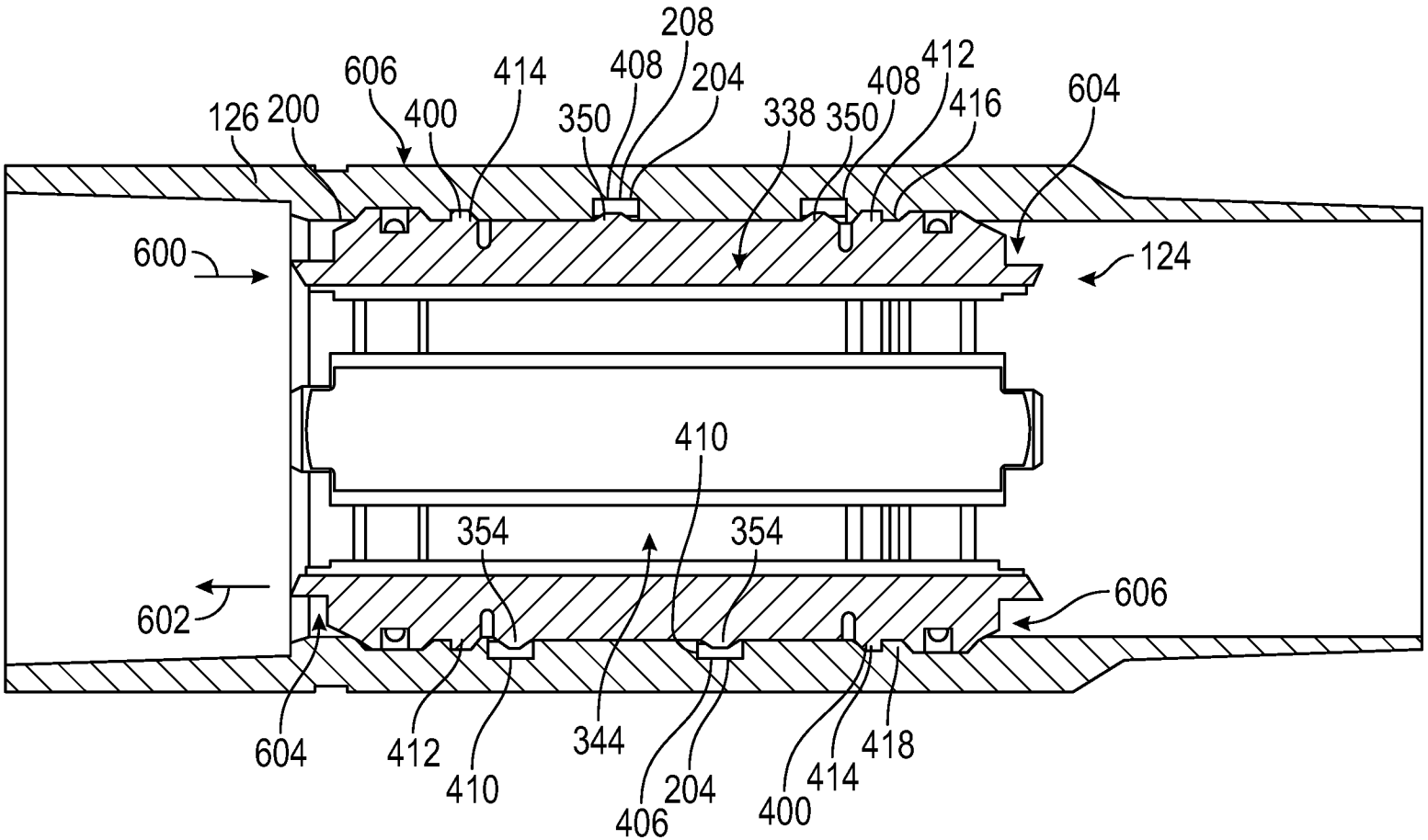
FIG. 6 illustrates a cross-sectional view of reversible key features of the latch assembly, in accordance with some embodiments of the present disclosure.

FIG. 6 illustrates a cross-sectional view of reversible key features of the latch assembly, in accordance with some embodiments of the present disclosure. As illustrated, the latch assembly 124 includes at least a first key feature 338 and a second key feature 344. Further, as illustrated, the first key feature 338 and the second key feature 344 have a same shape. That is, the first key protrusions 350 of the first key feature 338 and the second key protrusions 354 of the second key feature 344 have a same position, spacing, sizing, and orientation on their respective key features. The first key feature 338 and second key feature 344 may be manufactured with the same shape to reduce costs. Manufacturing a single key feature shape may be less expensive and less time-consuming in comparison to manufacturing multiple different key feature shapes.

Although the first key feature 338 and the second key feature 344 have the same shape, the first key feature 338 and the second key feature 344 may be secured to the latch assembly 124 at different orientations such that the latch assembly 124 may still only couple to the landing housing 126 in a single orientation. For example, as illustrated, the first key feature 338 may be mounted on the latch assembly 124 with an axially downward orientation 600 and the second key feature 344 may be mounted on the latch assembly 124 with an axially upward orientation 602. The corresponding key slots 204 (e.g., first key slot 208 and second key slot 406) in the inner surface 200 of the landing housing 126 may be positioned accordingly. For example, the first key slot 208 may have the first recesses 408 configured to receive the first key protrusions 350 with the first key feature 338 mounted on the latch assembly 124 with the axially downward orientation 600 such that the first key feature 338 is extendable into the first key slot 208 in only the axially downward orientation 600. Further, the second key slot 406 may have second recesses 410 configured to receive the second key protrusions 354 with the second key feature 344 mounted on the latch assembly 124 with the axially upward orientation 602 such that the second key feature 344 is extendable into the second key slot 406 in only the axially upward orientation 602.

Moreover, the first key feature 338 and the second key feature 344 may each include a plurality of load bearing protrusions 400. As illustrated, the first key feature 338 and the second key feature 344 may each include the first load bearing protrusion 412 positioned proximate respective first ends 604 of the key features 338, 344 and the second load bearing protrusion 414 positioned proximate respective second ends 606 of the key features 338, 344. The first key feature 338 and the second key feature 344 may comprise load bearing protrusions 400 positioned proximate each end 604, 606 of the respective key features 338, 344 such that the respective key features 338, 344 may interface with corresponding load bearing shoulders 416, 418 of the landing housing 126 in both the axially upward orientation 602 and the axially downward orientation 600. The corresponding load bearing shoulders 416, 418 may be positioned axially downhole from the corresponding key slots 208, 406. As such, the first key feature 338, mounted on the latch assembly 124 with the axially downward orientation 600, may be supported by the first load bearing protrusion 412 positioned proximate the first end 604 of the first key feature 338. That is, the first key feature 338 may interface with the corresponding first load bearing shoulder 416 to support the first key feature 338, the latch assembly 124, as well as any tool secured to the latch assembly. Further, the second key feature 344, mounted on the latch assembly 124 with the axially upward orientation 602, may be supported by the second load bearing protrusion 414 positioned proximate the second end 606 of the second key feature 344. That is, the second key feature 344 may interface with the corresponding second load bearing shoulder 418 to support the second key feature 344, the latch assembly 124, as well as any tool secured to the latch assembly 124.

Figure 7:
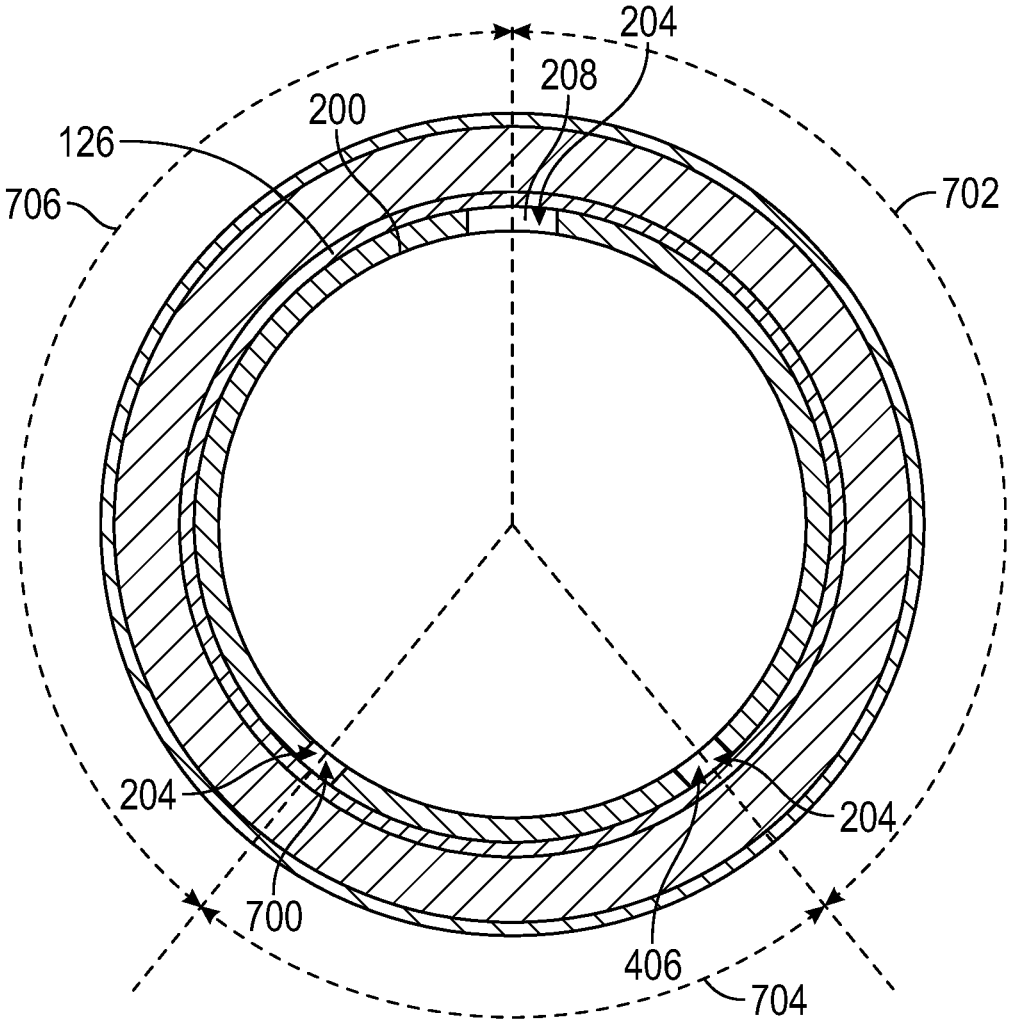
FIG. 7 illustrates a cross-sectional view of the landing housing having unevenly spaced key slots, in accordance with some embodiments of the present disclosure.

FIG. 7 illustrates a cross-sectional view of the landing housing having unevenly spaced key slots, in accordance with some embodiments of the present disclosure. In some embodiments, the key slots of the plurality of key slots 204 are evenly spaced about the circumference of the landing housing 126. However, as illustrated, the key slots of the plurality of key slots 204 formed in the inner surface 200 of the landing housing 126 may be unevenly spaced about the circumference of the inner surface 200 of the landing housing 126. For example, the landing housing 126 may have the first key slot 208, the second key slot 406, and a third key slot 700. The second key slot 406 may be angularly offset from the first key slot 208 in a clockwise direction by a first angle 702 one-hundred and thirty-five degrees, the third key slot 700 may be angularly offset from the second key slot 406 in the clockwise direction by a second angle 704 of ninety degrees, and the first key slot 208 may be angularly offset from the third key slot 700 in the clockwise direction by a third angle 706 of one-hundred and thirty-five degrees. However, the key slots 204 may include any suitable spacing about the circumference of the inner surface 200.

Having unevenly spaced key slots 204 may restrain coupling of the latch assembly 124 (shown in FIG. 3) to the landing housing 126 in non-desired orientations. For example, should the first key feature 338 enter the landing housing 126 in circumferential alignment with the second key slot 406, then the second key feature 344 (e.g., offset from the first key feature 338 in the clockwise direction by one-hundred and thirty-five degrees) would be misaligned from the third key slot 700, which is only offset from the second key slot 406 by the second angle 704 of ninety degrees. With the second key feature 344 circumferentially misaligned from a key slot 204, the latch assembly 124 may not couple with the landing housing 126. Accordingly, having the plurality of key slots 204 formed in the inner surface 200 of the landing housing 126 may be unevenly spaced about the circumference of the inner surface 200 of the landing housing 126 may allow for each key feature of the plurality of key features 304 to comprise a same key profile as the unevenly spaced key slots 204 may restrain coupling when the key features 304 are not circumferentially aligned with their corresponding key slots 204.

Figure 8:
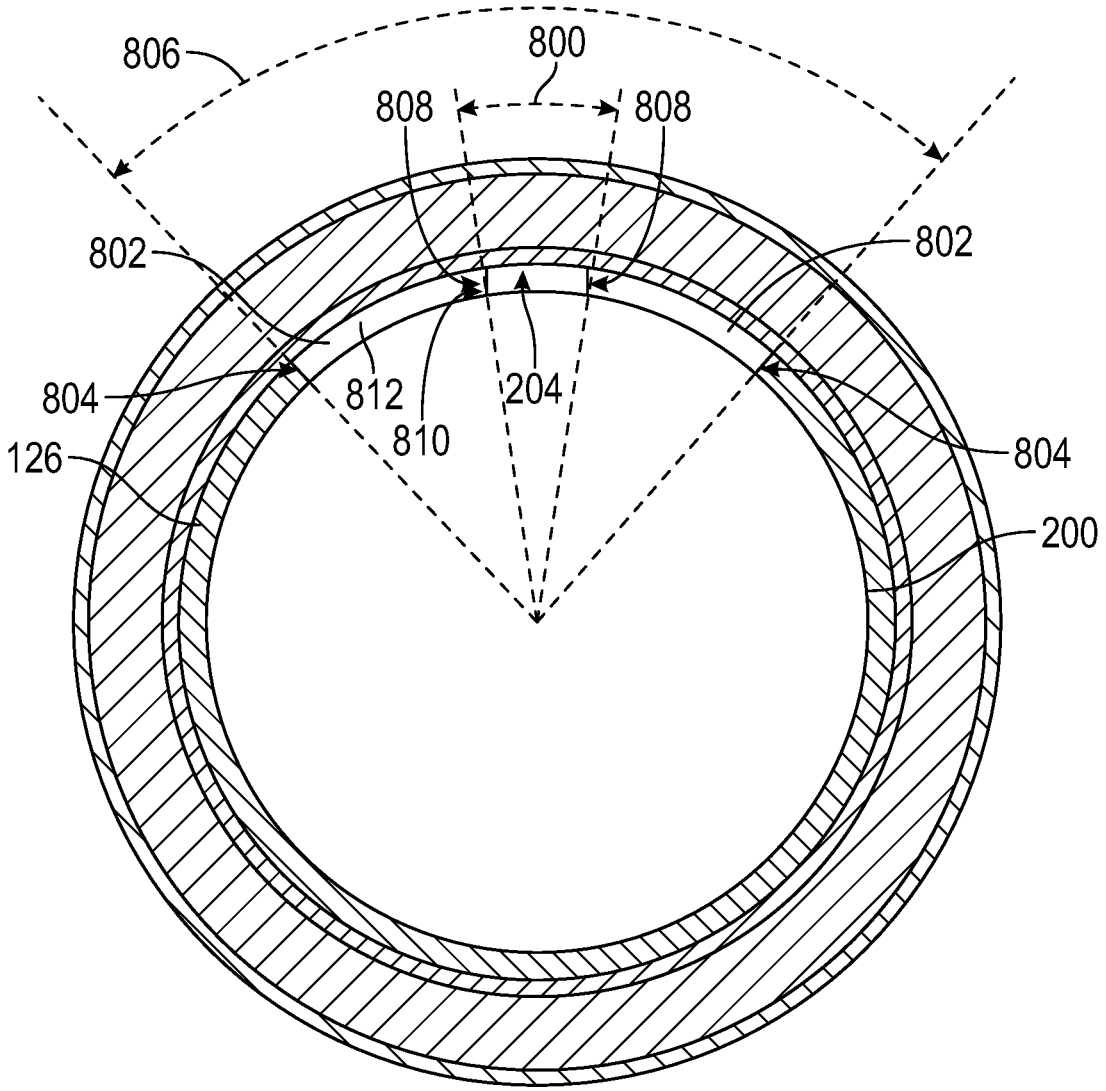
FIG. 8 illustrates a cross-sectional view of the landing housing having a funneling feature for correcting an orientation of the latch assembly with respect to the landing housing, in accordance with some embodiments of the present disclosure.

FIG. 8 illustrates a cross-sectional view of the landing housing having a funneling feature for correcting an orientation of the latch assembly with respect to the landing housing, in accordance with some embodiments of the present disclosure. The at least one key slot 204 may comprise a first angular width 800 between ten to fifty degrees about the circumference of the inner surface 200 of the landing housing 126. In the illustrated embodiment, the at least one key slot 204 has the first angular width 800 of about fifteen degrees. Generally, for the latch assembly 124 (shown in FIG. 3) to couple with the landing housing 126, the at least one key feature 304 must be circumferentially aligned with the at least one key slot 204 as the latch assembly 124 slides through the landing housing 126. However, inserting the latch assembly 124 into the landing housing 126 with the at least one key feature 304 in circumferential alignment with the at least one key slot 204 may be difficult, such that multiple attempts may be required to correctly align the latch assembly 124 with the landing housing 126.

As illustrated, the landing housing 126 may comprise a funneling feature 802 to expedite the coupling process. The funneling feature 802 is configured to catch and rotate the at least one key feature 304 into circumferential alignment with the at least one key slot 204 as the latch assembly slides into the landing housing 126. The funneling feature 802 may include a slot in the inner surface 200 of the landing housing 126 that is at least partially radially aligned with the at least one key slot 204. Further, the funneling feature 802 may have a uphole end 804 with an upper angular width 806 that is 10-350 degrees wider than the first angular width 800 of the at least one key slot 204. The upper angular width 806 of the funneling feature 802 may taper down to the first angular width 800 of the at least one key slot 204 at a downhole end 808 of the funneling feature 802. Further, the downhole end 808 of the funneling feature 802 may be circumferentially and axially aligned with an uphole end 810 of the at least one key slot 204. Accordingly, as the latch assembly 124 is inserted into the landing housing 126, the key feature 304 may contact a wall 812 of the funneling feature 802. As the at least one key feature 304 moves axially in the downhole direction, contact with the wall 812 of the funneling feature 802, which tapers down toward the at least one key slot 204, may rotate the at least one key feature 304 into the correct orientation with the at least one key slot 204.

Accordingly, the present disclosure may provide a system for landing a perforating gun in a specific orientation. Specifically, the system may include a perforating gun system secured to a latch assembly that is lowered down into a landing housing and only coupled to the landing housing when slid into the landing housing in a particular orientation. The system may include any of the various features disclosed herein, including one or more of the following statements Statement 1. A system for landing a perforating gun in a particular orientation, comprising: a landing housing securable within a wellbore of a downhole drilling operation, wherein the landing housing comprises at least one key slot extending into an inner surface of the landing housing; a latch assembly configured to couple to the landing housing in a particular orientation, wherein the latch assembly comprises: a tubular support structure having a central bore; at least one key feature having a body portion configured to extend and retract radially through a sidewall of the tubular support structure, and wherein the at least one key feature comprises at least one key protrusion formed on a radially outer surface of the body portion; a biasing mechanism configured to bias the at least one key feature in a radially outward direction with respect to the tubular support structure to drive the at least one key protrusion into the at least one key slot to couple the latch assembly to the landing housing; and a perforating gun system secured to the latch assembly, wherein the orientation of the latch assembly aims the perforating gun system in the wellbore.

Statement 2. The system of statement 1, wherein contact between the at least one key protrusion and the inner surface of the landing housing drives the at least one key feature to a retracted position, and wherein the latch assembly slides through the landing housing with the at least one key feature in the retracted position.

Statement 3. The system of statement 1 or statement 2, wherein the at least one key feature is biased to an extended position to couple the latch assembly to the landing housing in response to the at least one key protrusion being axially and circumferentially aligned with the corresponding at least one key slot.

Statement 4. The system of any preceding statement, wherein the at least one key feature comprises at least one load bearing protrusion formed on the radially outer surface of the body portion, wherein the at least one load bearing protrusion is configured to interface with a load bearing shoulder, formed on the landing housing, with the at least one key protrusion disposed in the corresponding at least one key slot.

Statement 5. The system of any preceding statement, wherein an angular width of the at least one key slot is between 10-50 degrees about a circumference of the inner surface of the landing housing.

Statement 6. The system of any preceding statement, wherein the landing housing comprises a funneling feature configured to catch and rotate the at least one key feature into circumferential alignment with the at least one key slot as the latch assembly slides into the landing housing, wherein an uphole end of the funneling feature comprises an angular width that is 10-350 degrees wider than the angular width of the at least one key slot.

Statement 7. The system of any preceding statement, wherein the perforating gun system is secured to the latch assembly via an indexing thread, wherein the indexing thread is configured to secure the perforating gun to the latch assembly at an adjustable angular orientation.

Statement 8. The system of any preceding statement, wherein the biasing mechanism is disposed within the central bore of the tubular support structure, and wherein the biasing mechanism comprises a central through bore such that downhole tools may be run through the latch assembly.

Statement 9. The system of any preceding statement, wherein the biasing mechanism comprises belleville springs and a push cam, wherein the belleville springs are configured to drive the push cam axially into a slanted surface of the body portion of the at least one key feature to bias the at least one key feature in a radially outward direction with respect to the tubular support structure.

Statement 10. The system of any preceding statement, wherein the at least one key feature comprises a plurality of key features, and wherein each key feature of the plurality of key features comprises a same key profile.

Statement 11. A system for landing a perforating gun in a particular orientation, comprising: a landing housing securable within a wellbore of a downhole drilling operation, wherein the landing housing comprises a plurality of key slots extending into an inner surface of the landing housing; a latch assembly configured to couple to the landing housing in a particular orientation, wherein the latch assembly comprises: a tubular support structure having a central bore; a first key feature having a first body portion configured to extend and retract radially through a first sidewall of the tubular support structure, and wherein the first key feature comprises a plurality of first key protrusions formed on a radially outer surface of the first body portion; a second key feature having a second body portion configured to extend and retract radially through a second sidewall of the tubular support structure, and wherein the second key feature comprises a plurality of second key protrusions formed on a radially outer surface of the second body portion; a plurality of biasing mechanisms configured to bias the first key feature and the second key feature in a radially outward direction with respect to the tubular support structure to drive the respective first key protrusions and second key protrusions into corresponding keys slots of the plurality of key slots to couple the latch assembly to the landing housing; and a perforating gun system secured to the latch assembly, wherein the orientation of the latch assembly aims the perforating gun system, wherein the perforating gun system comprises a plurality of charges configured to perforate a casing and/or sidewall of the wellbore upon detonation.

Statement 12. The system of statement 11, wherein the first key protrusions form a first key profile on the first key feature and the second key protrusions form a second key profile on the second key feature, wherein the first key profile is different than the second key profile.

Statement 13. The system of statement 11 or statement 12, wherein the plurality of key slots comprises a first key slot configured to receive the corresponding first key protrusions, wherein the first key slot comprises a plurality of axially aligned first recesses in the inner surface of the landing housing, wherein the axially aligned recesses have a same shape as the first key protrusions such that the first key protrusions are extendable into the first recesses when circumferentially aligned with the first recesses, and wherein at least one second key protrusion may contact the inner surface of the landing housing when circumferentially and axially aligned with the first recesses to restrain the second key protrusions from extending into the first key slot.

Statement 14. The system of any of statements 11-13, wherein first key feature and the second key feature comprise a same shape, wherein the first key feature is extendable into a first key slot of the plurality of key slots in only an axially downward orientation, and wherein the second key feature is extendable into a second key slot of the plurality of key slots in only an axially upward orientation.

Statement 15. The system of any of statements 11-14, wherein the first key feature and the second key feature each comprise at least one load bearing protrusion formed on the respective radially outer surfaces of the corresponding first and second body portions, wherein the at least one load bearing protrusion is configured to interface with a corresponding load bearing shoulder formed on the landing housing with the respective first and second key protrusions disposed in the corresponding key slots.

Statement 16. The system of any of statements 11-15, wherein the latch assembly comprises additional key features and the landing housing comprises additional corresponding key slots.

Statement 17. The system of any of statements 11-16, wherein the key slots of the plurality of key slots are evenly spaced about a circumference of the inner surface of the landing housing.

Statement 18. The system of any of statements 11-16, wherein the key slots of the plurality of key slots are unevenly spaced about a circumference of the inner surface of the landing housing.

Statement 19. A method of aligning a perforating gun in a wellbore, comprising: securing a landing housing within the wellbore; mounting a perforating gun system to a latch assembly at a desired angular orientation; lowering the latch assembly into the wellbore; sliding the latch assembly into the landing housing, wherein the latch assembly is configured to couple to the landing housing in response to at least one key feature of the latch assembly being circumferentially aligned with at least one corresponding slot feature of the landing housing; raising the latch assembly to a position uphole from the landing housing in response to the latch assembly sliding through the landing housing, wherein the latch assembly is configured to slide through the landing housing in response to misalignment of the at least one key feature and the at least one corresponding slot feature; indexing the latch assembly to another angular orientation with respect to the landing housing; and sliding the latch assembly into the landing housing.

Statement 20. The method of statement 19, further comprising the step of determining a position and orientation of the landing housing via a logging tool.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system for landing a perforating gun in a particular orientation, comprising:

a landing housing securable within a wellbore of a downhole drilling operation, wherein the landing housing comprises at least one key slot extending into an inner surface of the landing housing;

a latch assembly configured to couple to the landing housing in a particular orientation, wherein the latch assembly comprises:

a tubular support structure having a central bore;

at least one key feature having a body portion configured to extend and retract radially through a sidewall of the tubular support structure, and wherein the at least one key feature comprises at least one key protrusion formed on a radially outer surface of the body portion;

a biasing mechanism configured to bias the at least one key feature in a radially outward direction with respect to the tubular support structure to drive the at least one key protrusion into the at least one key slot to couple the latch assembly to the landing housing; and a perforating gun system secured to the latch assembly, wherein the orientation of the latch assembly aims the perforating gun system in the wellbore, wherein the perforating gun system is secured to the latch assembly via an indexing thread, wherein the indexing thread is configured to secure the perforating gun to the latch assembly at an adjustable angular orientation.

2. The system of claim 1, wherein contact between the at least one key protrusion and the inner surface of the landing housing drives the at least one key feature to a retracted position, and wherein the latch assembly slides through the landing housing with the at least one key feature in the retracted position.

3. The system of claim 1, wherein the at least one key feature is biased to an extended position to couple the latch assembly to the landing housing in response to the at least one key protrusion being axially and circumferentially aligned with the corresponding at least one key slot.

4. The system of claim 1, wherein the at least one key feature comprises at least one load bearing protrusion formed on the radially outer surface of the body portion, wherein the at least one load bearing protrusion is configured to interface with a load bearing shoulder, formed on the landing housing, with the at least one key protrusion disposed in the corresponding at least one key slot.

5. The system of claim 1, wherein an angular width of the at least one key slot is between 10-50 degrees about a circumference of the inner surface of the landing housing.

6. The system of claim 5, wherein the landing housing comprises a funneling feature configured to catch and rotate the at least one key feature into circumferential alignment with the at least one key slot as the latch assembly slides into the landing housing, wherein an uphole end of the funneling feature comprises an angular width that is 10-350 degrees wider than the angular width of the at least one key slot.

7. The system of claim 1, wherein the biasing mechanism is disposed within the central bore of the tubular support structure, and wherein the biasing mechanism comprises a central through bore such that downhole tools may be run through the latch assembly.

8. The system of claim 1, wherein the biasing mechanism comprises belleville springs and a push cam, wherein the belleville springs are configured to drive the push cam axially into a slanted surface of the body portion of the at least one key feature to bias the at least one key feature in a radially outward direction with respect to the tubular support structure.

9. The system of claim 1, wherein the at least one key feature comprises a plurality of key features, and wherein each key feature of the plurality of key features comprises a same key profile.

10. A system for landing a perforating gun in a particular orientation, comprising:

a landing housing securable within a wellbore of a downhole drilling operation, wherein the landing housing comprises a plurality of key slots extending into an inner surface of the landing housing;

a latch assembly configured to couple to the landing housing in a particular orientation, wherein the latch assembly comprises:

a tubular support structure having a central bore;

a first key feature having a first body portion configured to extend and retract radially through a first sidewall of the tubular support structure, and wherein the first key feature comprises a plurality of first key protrusions formed on a radially outer surface of the first body portion;

a second key feature having a second body portion configured to extend and retract radially through a second sidewall of the tubular support structure, and wherein the second key feature comprises a plurality of second key protrusions formed on a radially outer surface of the second body portion;

a plurality of biasing mechanisms configured to bias the first key feature and the second key feature in a radially outward direction with respect to the tubular support structure to drive the respective first key protrusions and second key protrusions into corresponding keys slots of the plurality of key slots to couple the latch assembly to the landing housing, and wherein the key slots are unevenly spaced about a circumference of the inner surface of the landing housing; and a perforating gun system secured to the latch assembly, wherein the orientation of the latch assembly aims the perforating gun system, wherein the perforating gun system comprises a plurality of charges configured to perforate a casing and/or sidewall of the wellbore upon detonation.

11. The system of claim 10, wherein the first key protrusions form a first key profile on the first key feature and the second key protrusions form a second key profile on the second key feature, wherein the first key profile is different than the second key profile.

12. The system of claim 10, wherein the plurality of key slots comprises a first key slot configured to receive the corresponding first key protrusions, wherein the first key slot comprises a plurality of axially aligned first recesses in the inner surface of the landing housing, wherein the axially aligned recesses have a same shape as the first key protrusions such that the first key protrusions are extendable into the first recesses when circumferentially aligned with the first recesses, and wherein at least one second key protrusion may contact the inner surface of the landing housing when circumferentially and axially aligned with the first recesses to restrain the second key protrusions from extending into the first key slot.

13. The system of claim 10, wherein the first key feature and the second key feature each comprise at least one load bearing protrusion formed on the respective radially outer surfaces of the corresponding first and second body portions, wherein the at least one load bearing protrusion is configured to interface with a corresponding load bearing shoulder formed on the landing housing with the respective first and second key protrusions disposed in the corresponding key slots.

14. The system of claim 10, wherein the latch assembly comprises additional key features and the landing housing comprises additional corresponding key slots.

15. A system for landing a perforating gun in a particular orientation, comprising:

a landing housing securable within a wellbore of a downhole drilling operation, wherein the landing housing comprises a plurality of key slots extending into an inner surface of the landing housing;

a latch assembly configured to couple to the landing housing in a particular orientation, wherein the latch assembly comprises:

a tubular support structure having a central bore;

a first key feature having a first body portion configured to extend and retract radially through a first sidewall of the tubular support structure, and wherein the first key feature comprises a plurality of first key protrusions formed on a radially outer surface of the first body portion;

a second key feature having a second body portion configured to extend and retract radially through a second sidewall of the tubular support structure, and wherein the second key feature comprises a plurality of second key protrusions formed on a radially outer surface of the second body portion;

a plurality of biasing mechanisms configured to bias the first key feature and the second key feature in a radially outward direction with respect to the tubular support structure to drive the respective first key protrusions and second key protrusions into corresponding keys slots of the plurality of key slots to couple the latch assembly to the landing housing, and wherein first key feature and the second key feature comprise a same shape, wherein the first key feature is extendable into a first key slot of the plurality of key slots in only an axially downward orientation, and wherein the second key feature is extendable into a second key slot of the plurality of key slots in only an axially upward orientation; and a perforating gun system secured to the latch assembly, wherein the orientation of the latch assembly aims the perforating gun system, wherein the perforating gun system comprises a plurality of charges configured to perforate a casing and/or sidewall of the wellbore upon detonation.

16. The system of claim 15, wherein the key slots of the plurality of key slots are evenly spaced about a circumference of the inner surface of the landing housing.

17. A method of aligning a perforating gun in a wellbore, comprising:

securing a landing housing within the wellbore;

mounting a perforating gun system to a latch assembly at a desired angular orientation, wherein the perforating gun system is secured to the latch assembly via an indexing thread, wherein the indexing thread is configured to secure the perforating gun to the latch assembly at an adjustable angular orientation;

lowering the latch assembly into the wellbore;

sliding the latch assembly into the landing housing, wherein the latch assembly is configured to couple to the landing housing in response to at least one key feature of the latch assembly being circumferentially aligned with at least one corresponding slot feature of the landing housing;

raising the latch assembly to a position uphole from the landing housing in response to the latch assembly sliding through the landing housing, wherein the latch assembly is configured to slide through the landing housing in response to misalignment of the at least one key feature and the at least one corresponding slot feature;

indexing the latch assembly to another angular orientation with respect to the landing housing; and sliding the latch assembly into the landing housing.

18. The method of claim 17, further comprising the step of determining a position and orientation of the landing housing via a logging tool.

* * * * *